US008974361B2

(12) United States Patent
Fischer et al.

(10) Patent No.: US 8,974,361 B2
(45) Date of Patent: Mar. 10, 2015

(54) CENTRIFUGE WITH COMPRESSOR COOLING

(71) Applicant: Eppendorf AG, Hamburg (DE)

(72) Inventors: Sven Fischer, Leipzig (DE); Heiko Mueller, Panitzsch (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 13/915,296

(22) Filed: Jun. 11, 2013

(65) Prior Publication Data

US 2013/0298577 A1 Nov. 14, 2013

Related U.S. Application Data

(63) Continuation of application No. 13/858,060, filed on Apr. 7, 2013.

(30) Foreign Application Priority Data

Jun. 14, 2011 (DE) ..... 10 2011 105 878

(51) Int. Cl.
*B04B 15/02* (2006.01)
*B04B 7/02* (2006.01)
*F25D 31/00* (2006.01)

(52) U.S. Cl.
CPC . *B04B 15/02* (2013.01); *B04B 7/02* (2013.01); *F25D 31/00* (2013.01)
USPC ..... 494/14; 62/1

(58) Field of Classification Search
USPC ..... 62/62, 453; 165/47, 168–170; 494/14
See application file for complete search history.

(56) References Cited

U.S. PATENT DOCUMENTS

| | | | | |
|---|---|---|---|---|
| 7,407,473 | B2 | 8/2008 | Saviano | |
| 2003/0029189 | A1 * | 2/2003 | Wilson | 62/506 |
| 2003/0221442 | A1 * | 12/2003 | Lee et al. | 62/453 |

FOREIGN PATENT DOCUMENTS

| | | | |
|---|---|---|---|
| DE | 2343070 | A1 | 3/1975 |
| GB | 1 018 285 | A | 1/1966 |
| JP | 2010274230 | A | 12/2010 |

* cited by examiner

*Primary Examiner* — Allen Flanigan
(74) *Attorney, Agent, or Firm* — Von Rohrscheidt Patents

(57) ABSTRACT

The present invention relates to a centrifuge and a method for cooling a centrifuge. The centrifuge according to the invention includes a cooling device which is improved in that its required installation space is reduced such that the centrifuge can be of a more compact design with the centrifugation capacity remaining unchanged, or the centrifugation capacity can be increased with the installation space remaining unchanged. Further, the number of components can be reduced and thus cost and assembly time can be saved.

17 Claims, 14 Drawing Sheets

CENTRIFUGE WITH COMPRESSOR COOLING

RELATED APPLICATIONS

This application is a continuation of International application PCT/EP2012/002435 filed on Jun. 8, 2012 claiming priority from German application DE 10 2011 105 878.1 filed on Jun. 14, 2011. All the above applications are incorporated in their entirety by this reference.

FIELD OF THE INVENTION

The present invention relates to a centrifuge, in particular a laboratory centrifuge.

BACKGROUND OF THE INVENTION

During centrifugation, air friction and electrical power loss produce heat in a centrifuge bowl during rotation of the centrifuge rotor. Since the centrifuge bowl is closed with a cover to prevent material to be centrifuged from escaping, this heat input cannot readily be dissipated and thus leads to an increase in temperature of a material to be centrifuged.

This temperature increase is, however, undesirable since it may lead to destruction and/or uselessness of the centrifuged samples. Usually, the samples must be kept at a defined temperature, e. g. at temperatures of 4° C., 22° C. or 37° C., depending on the respective application. Therefore, precautionary measures have already been taken in the past to prevent an increase in the temperature of the material to be centrifuged. On the one hand, this can be achieved by direct cooling, or by indirect cooling by means of the heat exchanger principle. In the case of indirect cooling (collateral cooling) there is no direct contact between the cooling agent and the product to be cooled and/or the envelope of the product to be cooled. Such centrifuges are described in U.S. Pat. No. 7,407,473 B2 and GB 1 018 285 A.

In the case of direct cooling, ambient air is conveyed directly at the centrifuge rotor through the centrifuge bowl with the rotor acting as a radial fan. For this purpose, the centrifuge cover and/or the centrifuge bowl include an inlet opening near a axis and an outlet opening located farther away with respect to the rotation axis. Although such a direct cooling has proved its worth, the centrifuge bowl must include an outlet opening which also allows material to escape. A disadvantage of direct cooling is the use of ambient air as a cooling agent: the sample product can at the most be cooled to the temperature of the ambient air.

In the case of indirect cooling, the rotor is enclosed in the centrifuge bowl below the centrifuge cover, and no cooling duct or the like is provided. Thus, the air circulates only inside the centrifuge bowl. Cooling is achieved with the aid of a second agent which is directed past the outside of the vessel. This agent may either be ambient air which is directed past the outside of the vessel, as is implemented in the centrifuge 5424 of Eppendorf AG, for example. Alternatively, the cooling device is composed of a compressor cooling apparatus including pipes and heat exchangers which are arranged above the equipment-side base plate, wherein, for dissipating heat, a special cooling agent is directed past the vessel via pipes which helically bear against the vessel, for example, i. e. the side walls and the bottom of the vessel. The latter variant of indirect cooling also allows for cooling the sample product to a temperature below the temperature of the ambient air. An advantage of indirect cooling is that in this process the temperature to be adjusted can be better controlled as compared with direct cooling.

In known centrifuges, the centrifuge base plate usually made of metal merely serves for passive dissipation of a portion of the heat from the inside of the housing.

But also in the case of rotors running in a vacuum in so-called ultracentrifuges this principle of passive cooling via the base plate is applied as is disclosed in DE 23 43 070 A1, for example.

BRIEF SUMMARY OF THE INVENTION

It is an object of the present invention to further improve active indirect cooling of centrifuges. In particular, the required installation space is to be reduced such that the centrifuges can be of a more compact design with the centrifugation capacity remaining unchanged, or the centrifugation capacity can be increased with the installation dimension remaining unchanged. Further, it is in particular intended to reduce the number of components and thus saving costs and assembly time.

According to the invention, this object is achieved through a centrifuge including a driven centrifuge rotor; a compressor cooling device; a housing; and a base plate, wherein the base plate receives heat from the compressor cooling device so that the base plate forms a heat exchanger for the compressor cooling device and operates at least as a portion of a condenser for a cooling medium of the compressor cooling device.

The object is also achieved through a method for cooling a centrifuge including the steps: using a base plate of a centrifuge at least as a portion of a condenser of a compressor cooling device, and receiving heat from the compressor cooling device in the base plate so that the base plate forms a heat exchanger for the compressor cooling device.

Advantageous embodiments are stated in the dependent claims.

The inventors have found that in present-day centrifuges a separate condenser and/or gas cooler for the cooling medium of the compressor cooling apparatus can be omitted when the base plate is used as a heat exchanger for the cooling agent to dissipate the heat thereof. In the case of a gas cooler, heat dissipation is not effected via the condenser, but in a trans critical process sensible heat is dissipated from the hot gas. In the condenser, on the other hand, a phase transformation takes place in three steps: heating of the hot gas, liquefying and super cooling the liquid cooling agent. The condenser and the gas cooler have the same basic component design and need only be configured according to the respective application. Therefore, hereinafter the term condenser also includes gas coolers.

While the base plate has so far been used for passive cooling, i.e. dissipation of heat from the electronics system of the centrifuge, it now forms part of a compressor cooling apparatus and is thus used for active cooling of the centrifuge. The cooling medium flowing out of the compressor, which may have a temperature of up to 120° C., is cooled down, depending on the ambient temperature, to temperatures of approximately 35° C. (at an ambient temperature of approximately 20° C.). Since the normally used condenser of the compressor cooling apparatus is omitted, additional installation space beside/in front of/behind the rotor is available since such condensers have so far been arranged there. This additional installation space can now be used for accommodating the electronic control system which, as a general rule, should not be arranged below the rotor, pipes or other components of the cooling device because of the risk of accumulation of condensation water.

In the centrifuge, in particular a laboratory centrifuge, including a centrifuge rotor, a centrifuge motor, a compressor cooling device and a machine frame including a base plate, it is therefore, according to the invention, provided for the base plate to be in heat conducting communication with the compressor cooling device such that the base plate acts as a heat exchanger for the compressor cooling device and thus acts at least as a portion of a condenser for the cooling medium of the compressor cooling device.

This configuration allows for omitting a separate condenser, and an installation space for such a condenser is not required, which offers advantages with regard to the installation dimension of the centrifuge according to the invention as compared with previous configurations. Alternatively, the centrifugation capacity can be increased with the installation dimension remaining unchanged. Further, the cost and the assembly effort are reduced.

In an advantageous configuration it is provided for a conveying means for the cooling agent to be arranged at and/or in the base plate, wherein the conveying means is advantageously configured as a pipe. In this case, the base plate configured as a condenser is of a particularly simple design. Further, configuration as a pipe allows for optimum tightness to be ensured and, moreover, an optimum flow in a pipe, in particular without any resistance, to be ensured, since otherwise a pressure drop and thus a deterioration of the cooling effect would occur.

In this context, the conveying means is advantageously molded into the base plate, or the base plate is of at least bipartite design and the conveying means is arranged in the parting plane between the two parts, in particular incorporated in at least one part. For example, the conveying means can be molded into the base plate, wherein in particular a copper pipe is used which is molded into the base plate made of aluminum. Alternatively, a sandwich structure can be used, wherein a relatively high accuracy of fit must be ensured in order to prevent leakages. Alternatively, an incorporated pipe may be used in the sandwich structure in order to prevent leakages. Here, too, a high accuracy of fit is required to ensure an optimum heat transfer between the pipe and the sandwich parts of the base plate since otherwise air inclusions or the like impede the heat transfer. To prevent this, a means for improving the heat transfer, e. g. a heat transfer paste, is advantageously arranged between the pipe and the sandwich parts of the base plate.

It is particularly advantageous when the base plate includes at least one surface-increasing element, in particular one or a plurality of cooling ribs, on at least one of the two large main surfaces. In this case the base plate can particularly well dissipate the heat of the cooling agent since its surface is advantageously increased for cooling purposes, and for actively cooling the base plate a slow/small air flow can be used for noise reduction. Further, these cooling ribs may appropriately be used for directing the air flow used for active cooling. These elements do not require a separate installation space since enough space is available due to the bearing support between the base plate and the vessel, and below the base plate, too, such installation space is available.

Further, it may advantageously be provided for the base plate to include at least one through hole which is not in fluid communication with the conveying device. Thus passively or actively generated air flows can be easily directed since such an air flow can now also pass though the base plate. In a particularly advantageous embodiment, such through holes are used for interrupting and/or stopping the heat conductance of the base plate in a controlled manner to separate the hot input from the cold output in the condenser and thus increase the efficiency thereof.

Although passive cooling of the base plate is definitely possible by appropriately directing the air flow, inter alia with the aid of surface-increasing elements, it is particularly advantageous to provide for active cooling of the base plate by means of at least one ventilation means to prevent heat accumulation inside the centrifuge. The ventilation means, e. g. a fan, is operatively connected with the base plate and is advantageously adapted to generate an air flow in the housing of the centrifuge, said air flow entering the housing from the side and/or the bottom. To increase the resistance to fire an air-permeable cover for ventilation openings in the housing may be provided.

Further, this ventilation means is particularly efficient with regard to the dissipation of heat generated by motor and electronic drive unit, produced by air resistance in the centrifuge bowl, introduced by the samples to be centrifuged and/or produced during the centrifugation process, as well as heat entering from outside, e. g. through the cover, into the centrifuge. This ventilation means thus offers substantial support for compressor cooling.

To prevent contact with hot parts of the centrifuge, it may be provided for the base plate to be arranged at the housing of the centrifuge such that the heat transfer between the base plate and the housing is interrupted or at least reduced. For this purpose, a heat-insulating connection is arranged between the base plate and the housing of the centrifuge.

Independent protection is claimed for the method according to the invention for cooling a centrifuge, in particular a laboratory centrifuge, with a compressor cooling device being provided, which method is characterized in that a base plate of the centrifuge is used at least as a portion of a condenser of the compressor cooling device.

It is particularly advantageous when a ventilation means is provided which generates an air flow parallel to and/or rising through the base plate. Thus, particularly efficient active cooling of the base plate is implemented such that the latter acts as a condenser in a particularly efficient manner.

In the method according to the invention it is particularly advantageous to use the centrifuge according to the invention.

BRIEF DESCRIPTION OF THE DRAWINGS

Features of the present invention and further advantages are described with based on advantageous embodiments with reference to drawing figures wherein.

DETAILED DESCRIPTION OF THE INVENTION

Figure 1:
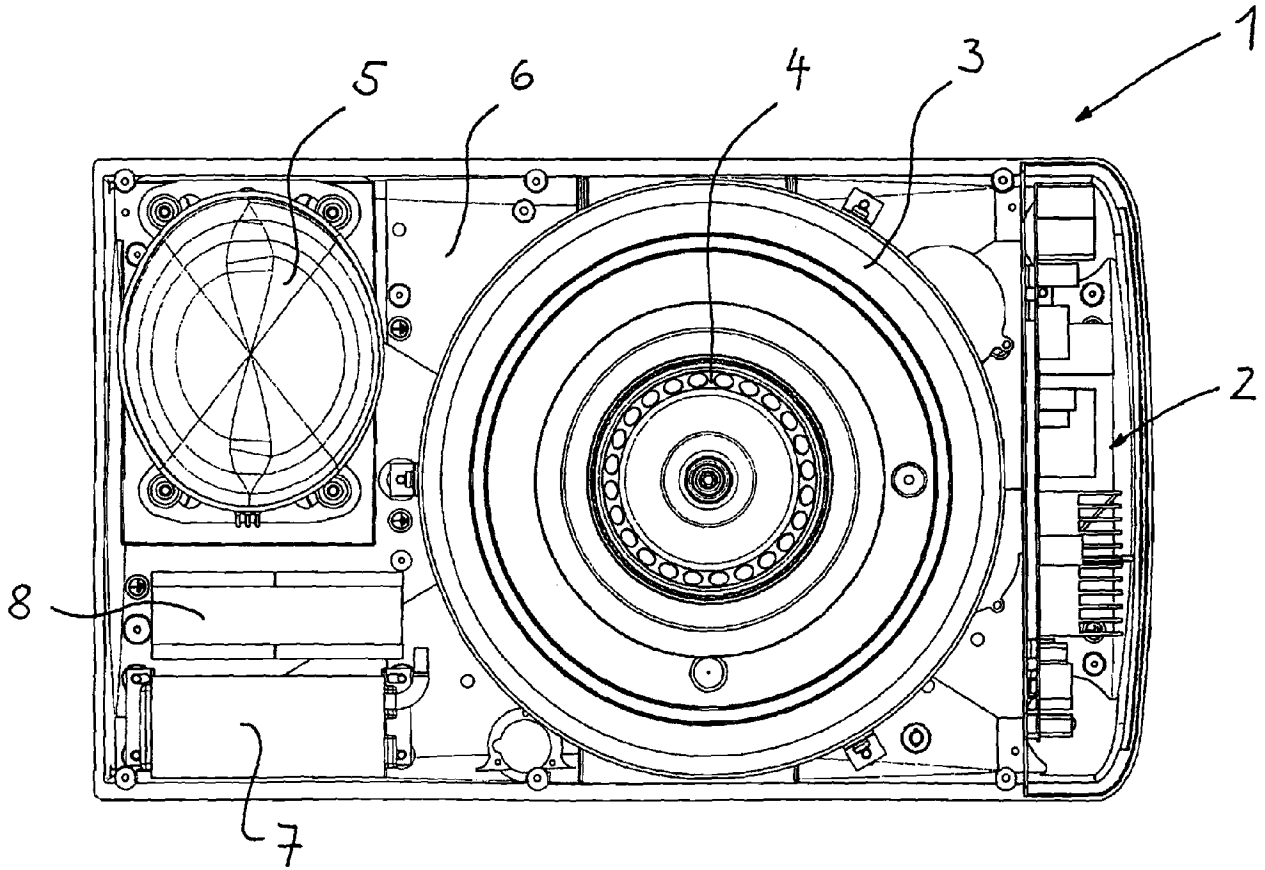
FIG. 1 PRIOR ART
FIG. 1 illustrates a top view of a known centrifuge including a condenser without illustrating housing components.

FIG. 1 schematically illustrates a cutaway top view of a known laboratory centrifuge 1 including an electronics system 2, a centrifuge bowl 3 and a motor (not shown) arranged beneath, a centrifuge rotor 4, a compressor 5 and a base plate 6 and a condenser 7.

Figure 2:
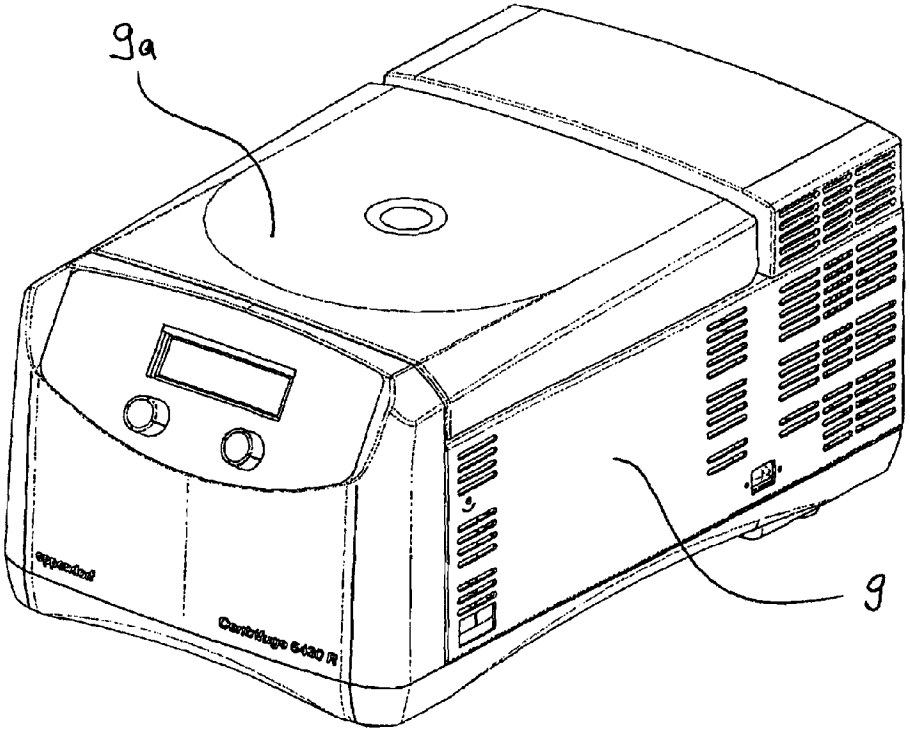
FIG. 2 PRIOR ART
FIG. 2 illustrates a perspective overall view of the centrifuge of FIG. 1.

Between the compressor 5 and the condenser 7 a fan 8 for the condenser 7 is arranged. FIG. 2 is a perspective view of this conventional centrifuge 1 together with the housing 9 and the cover 9*a*.

Figure 3:
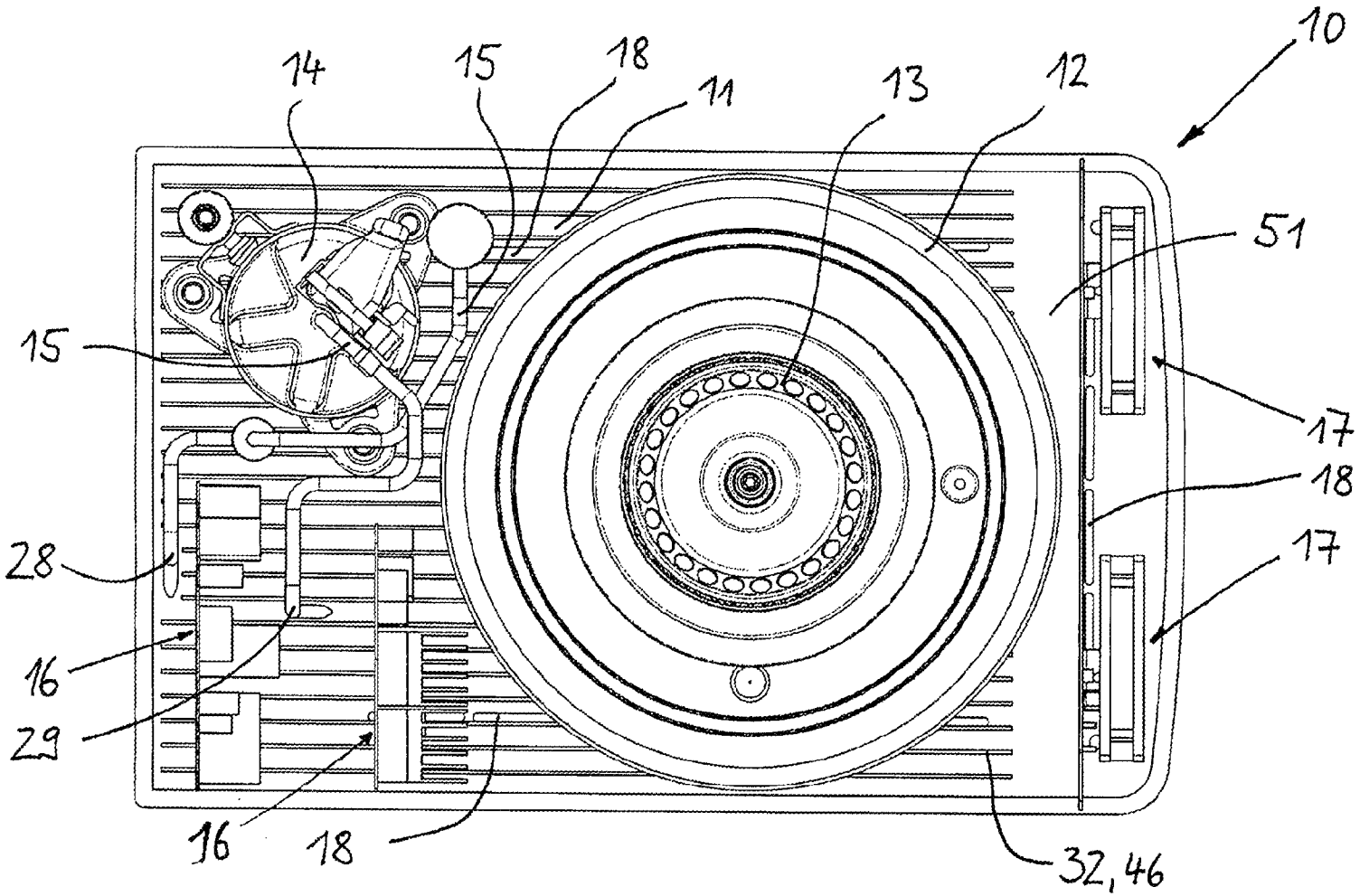
FIG. 3 illustrates a top view of the centrifuge according to the invention without illustrating housing components.
Figure 4A:
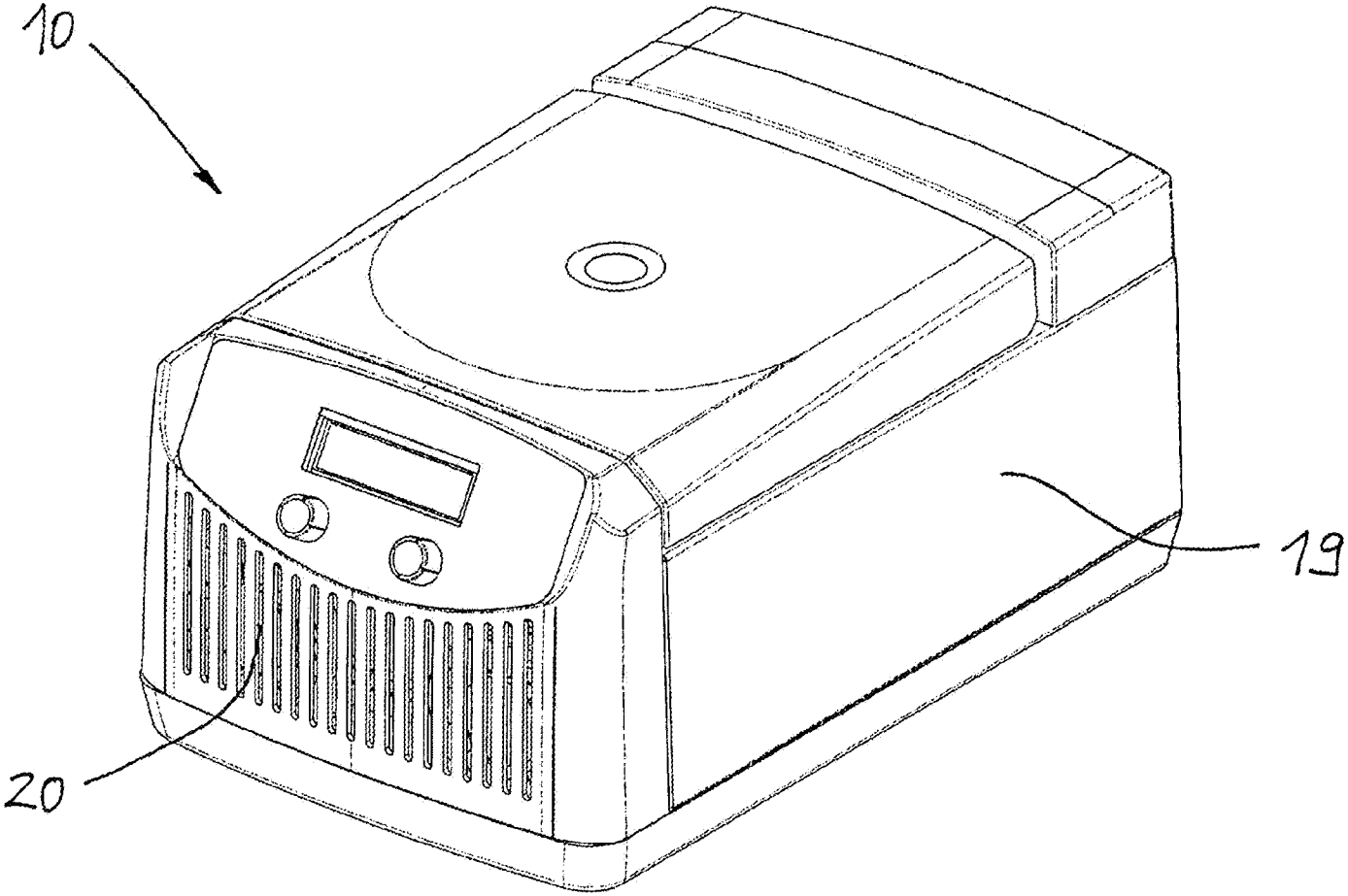
FIGS. 4*a*, 4*b* illustrate various perspective overall views of the centrifuge according to the invention of FIG. 3.
Figure 4B:
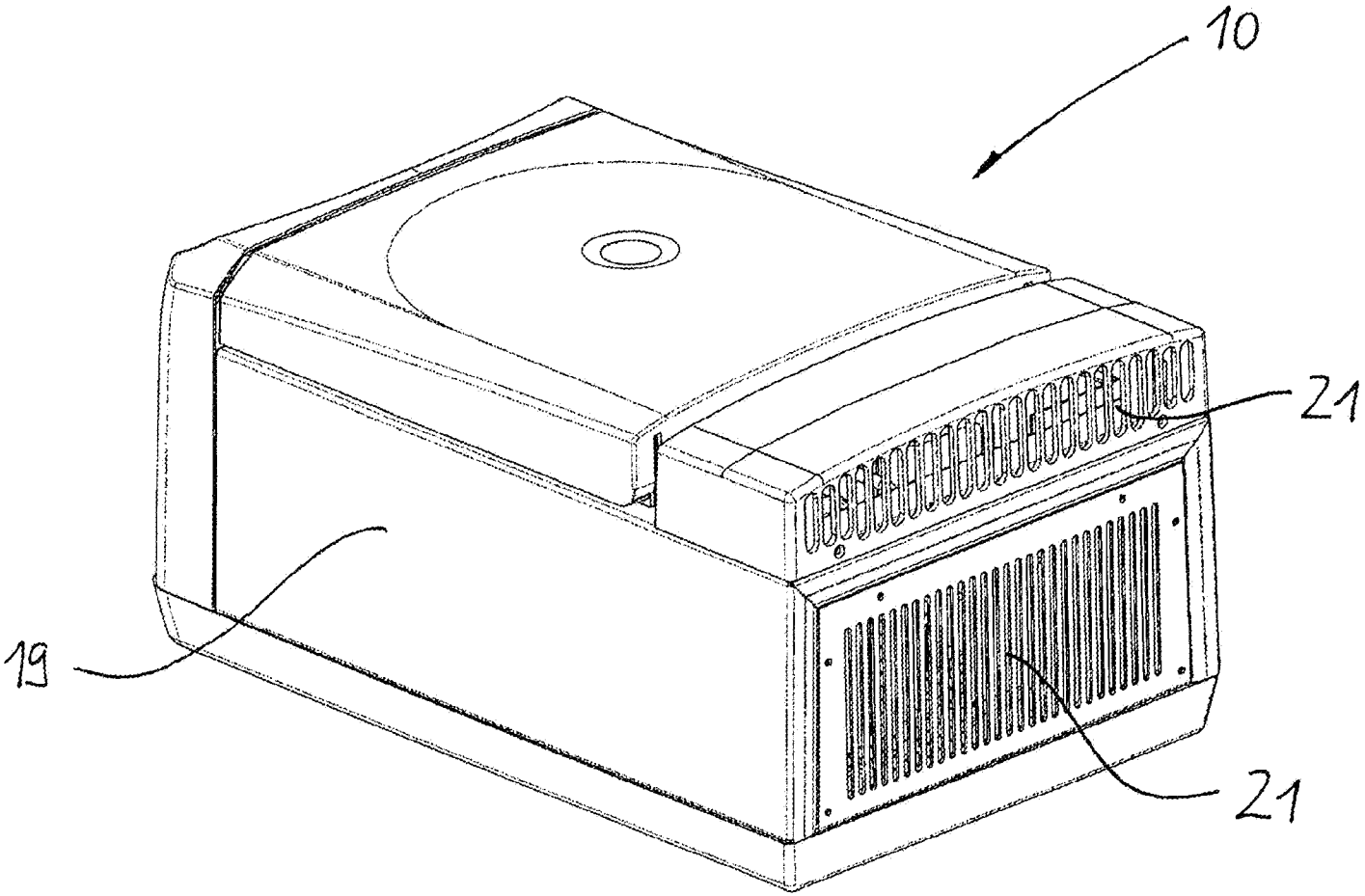
Figure 5:
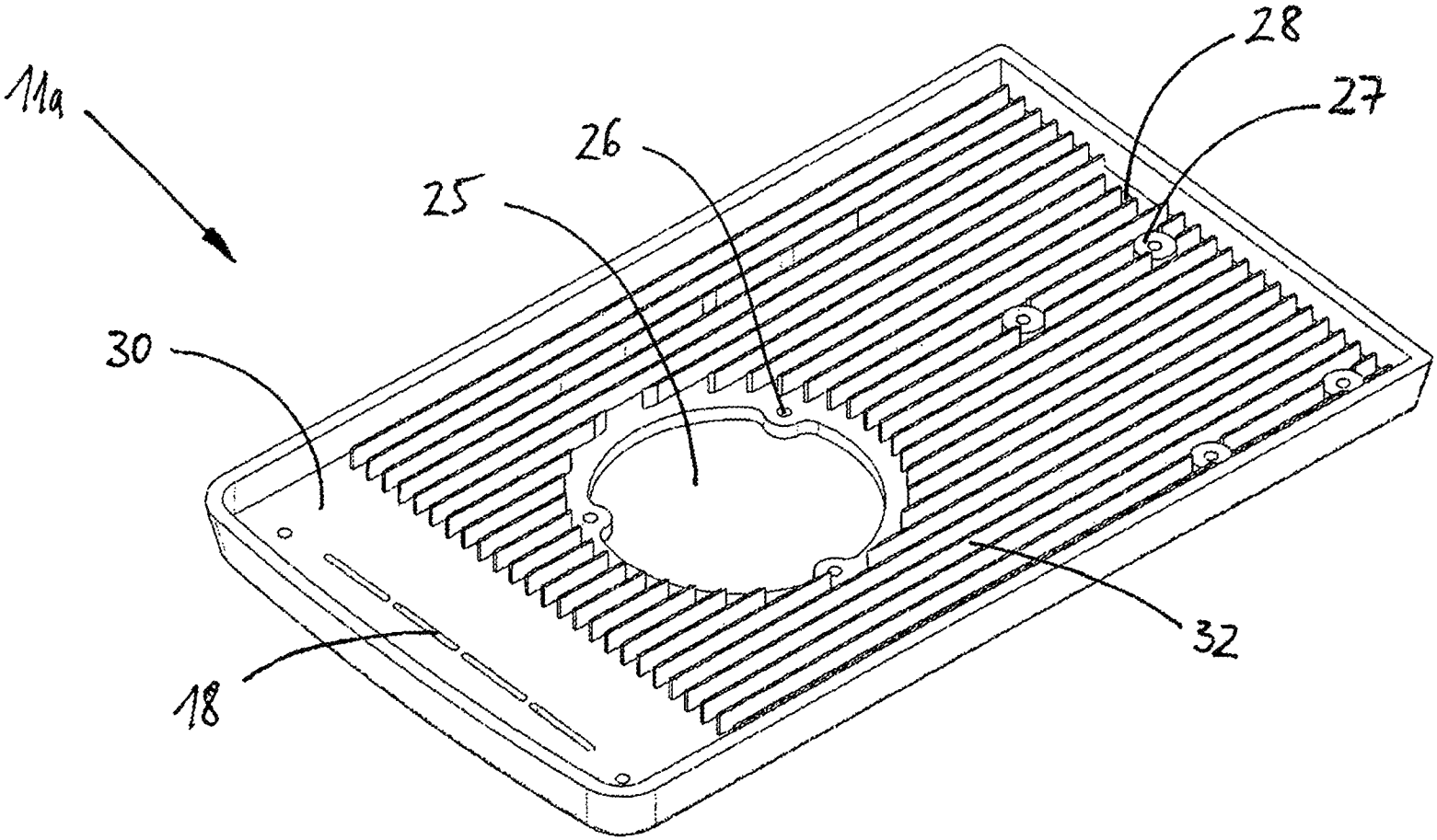
FIG. 5 illustrates a perspective top view of the base plate for the centrifuge according to the invention of FIG. 3, in a first advantageous embodiment.
Figure 6:
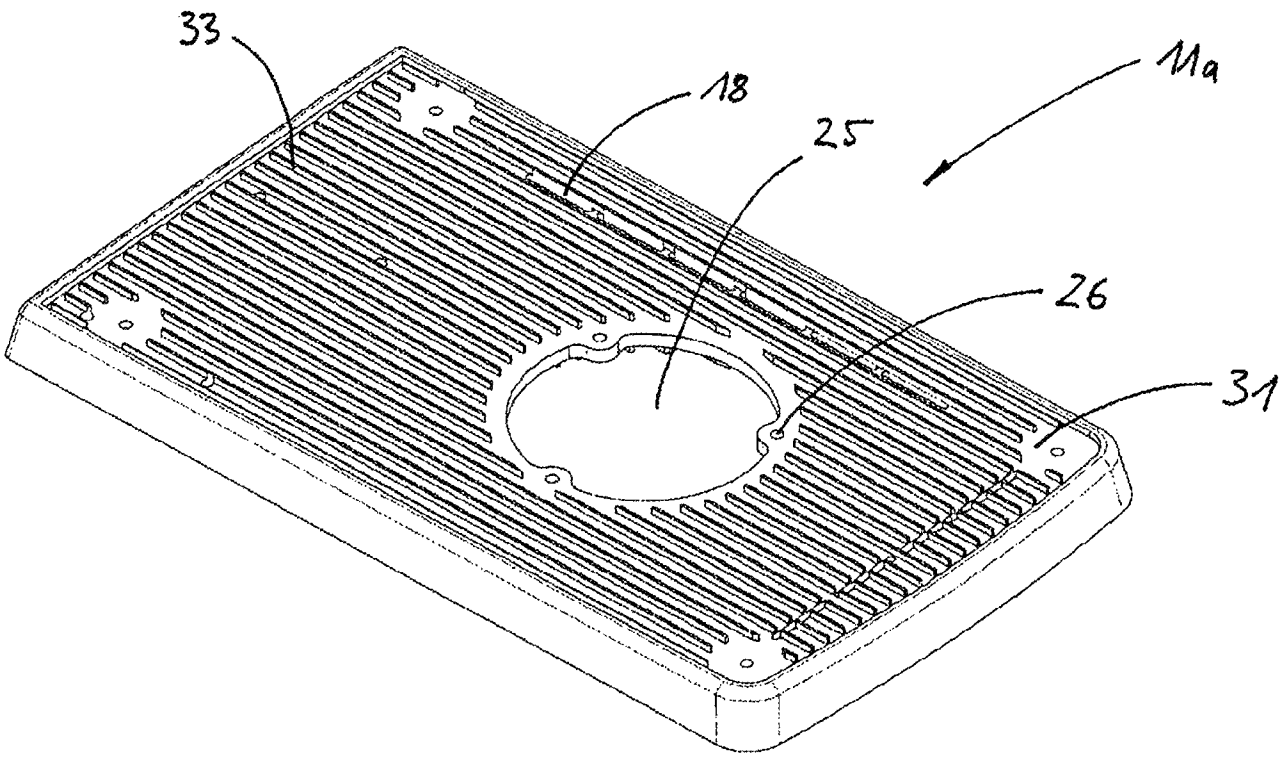
FIG. 6 illustrates a perspective bottom view of the base plate for the centrifuge according to the invention of FIG. 3, in the first advantageous embodiment.
Figure 7:
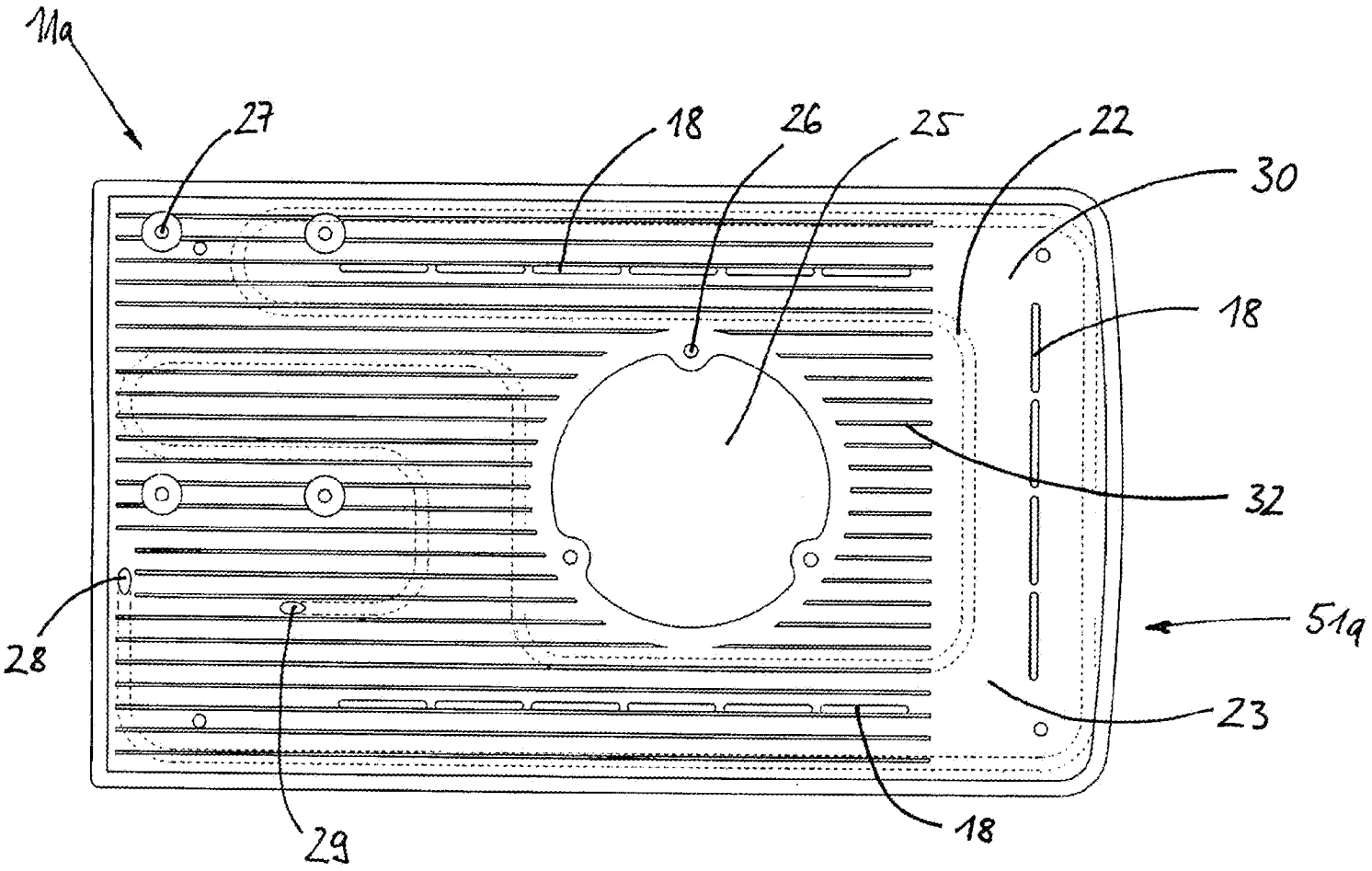
FIG. 7 illustrates a top view of the base plate for the centrifuge according to the invention of FIG. 3, in a first advantageous embodiment.
Figure 8:
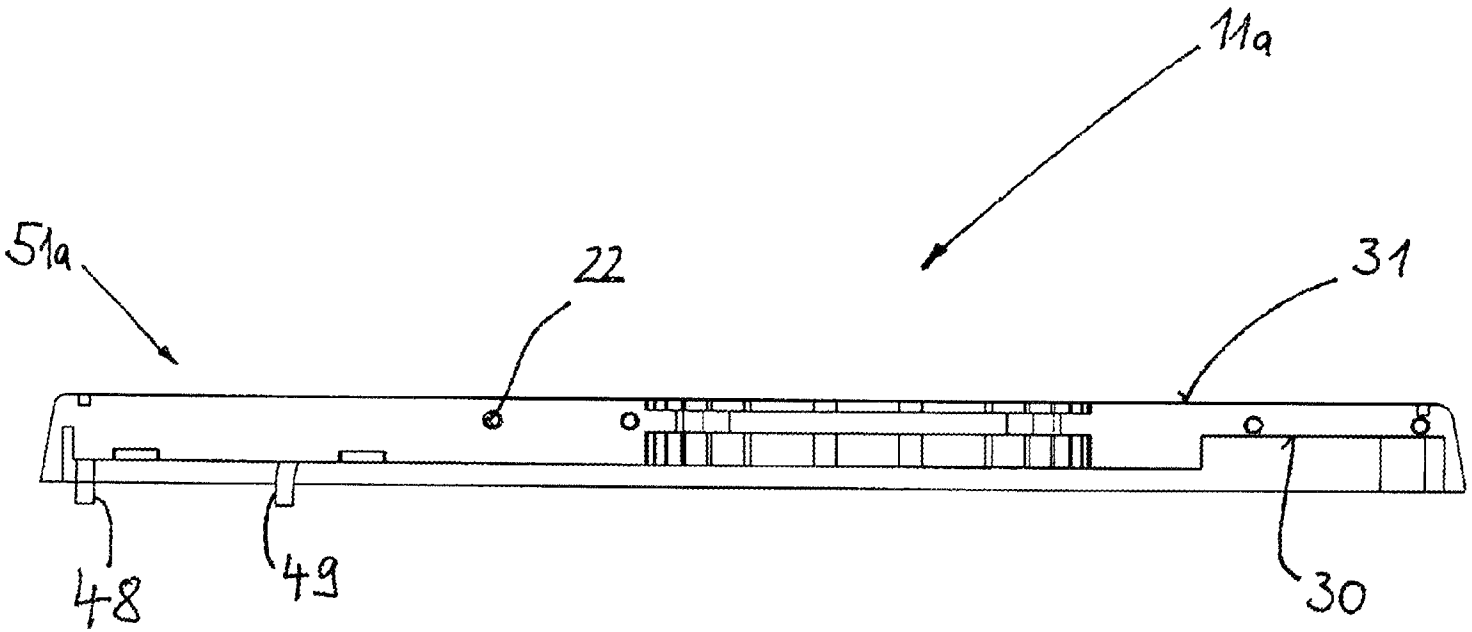
FIG. 8 illustrates a sectional view of the base plate for the centrifuge ac cording to the invention of FIG. 3, in the first advantageous embodiment.
Figure 9:
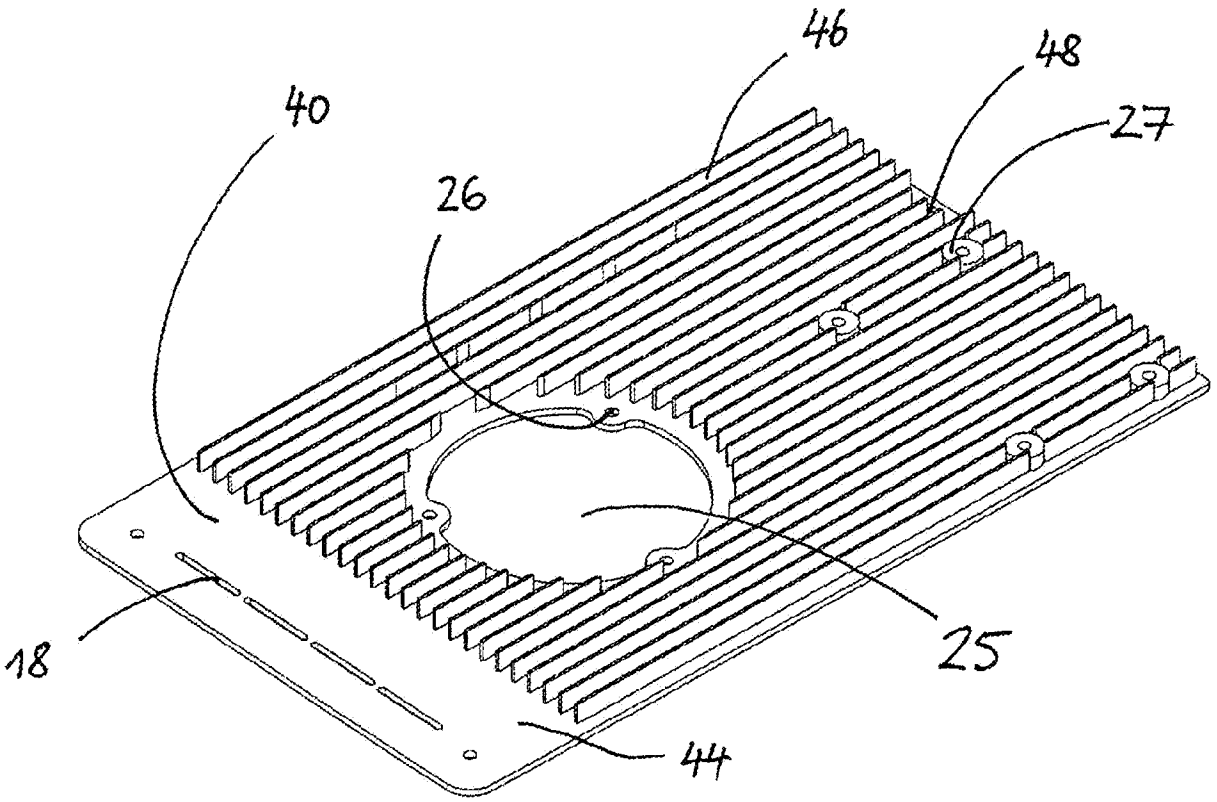
FIG. 9 illustrates a perspective top view of the base plate for the centrifuge according to the invention of FIG. 3, in a second advantageous embodiment with the upper part of a sandwich base plate.
Figure 10:
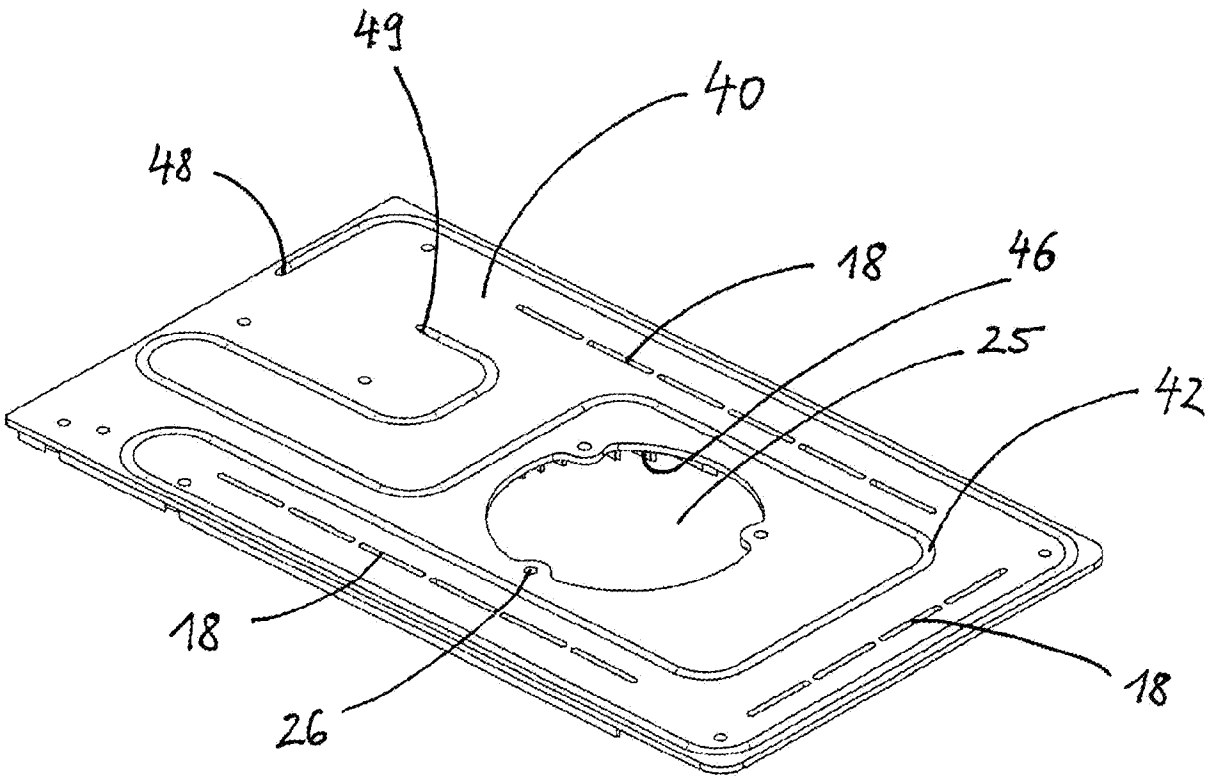
FIG. 10 illustrates a perspective bottom view of the base plate for the centrifuge according to the invention of FIG. 3, in the second advantageous embodiment with the upper part of a sandwich base plate.
Figure 11:
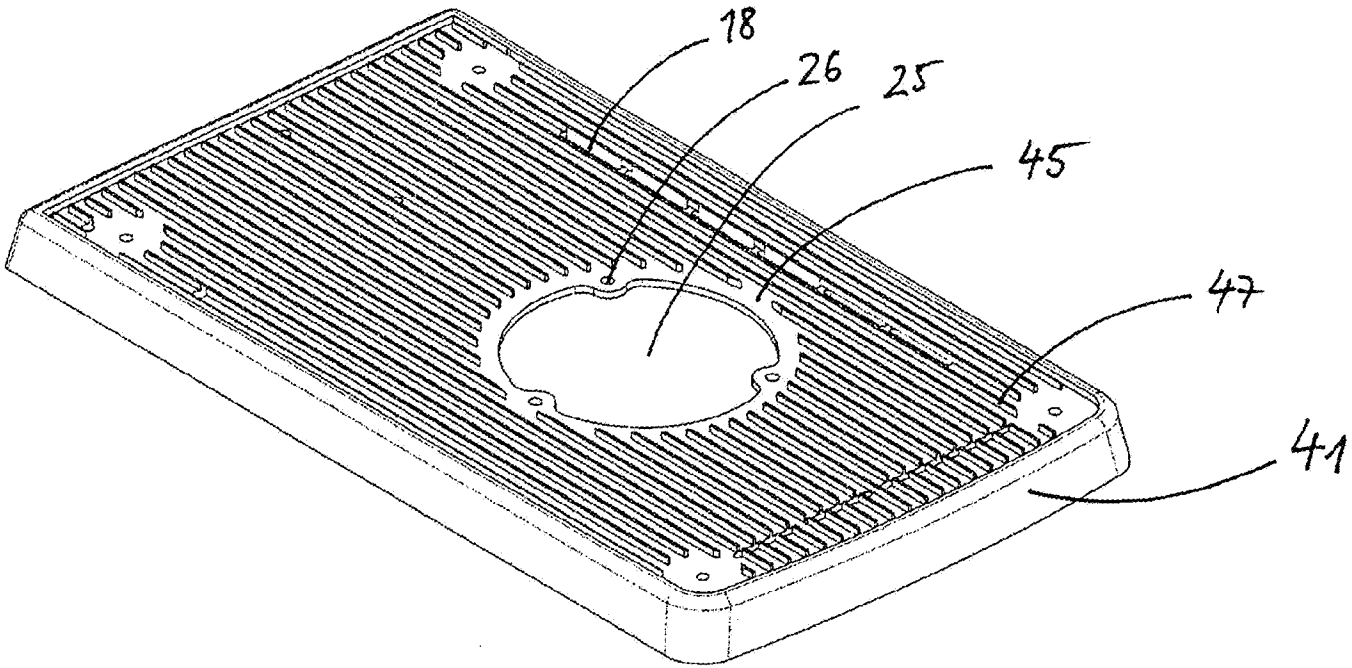
FIG. 11 illustrates a perspective bottom view of the base plate for the centrifuge according to the invention of FIG. 3, in the second advantageous embodiment with the lower part of a sandwich base plate.
Figure 12:
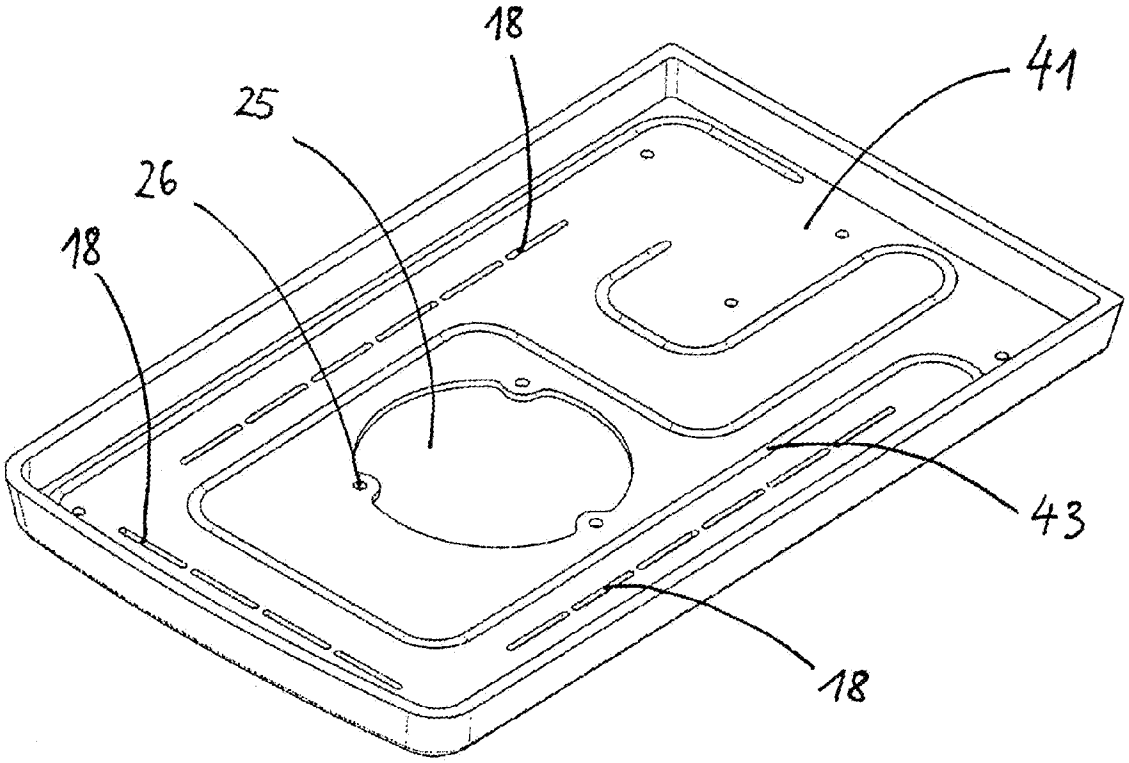
FIG. 12 illustrates a perspective top view of the base plate for the centrifuge according to the invention of FIG. 3, in the second advantageous embodiment with the lower part of a sandwich base plate.

FIG. 3 schematically illustrates a cutaway top view of the centrifuge 10 according to the invention in an advantageous embodiment. FIGS. 4*a*, 4*b* show various perspective views of the centrifuge 10 according to the invention.

It is illustrated that the centrifuge 10 includes a base plate 11 and a vessel 12 including a centrifuge rotor 13, wherein at the base plate 11 below the vessel the centrifuge motor is arranged through its bearing support (bearing support and centrifuge motor constitute a unitary component known to a person skilled in the art and are not separately shown). The centrifuge 10 includes a compressor cooling device 14 including a cooling agent line 15 which is passed through the base plate 11. Further, the centrifuge 10 includes an electronic control system 16 and two fans 17 which draw air into the housing 19 through ventilation slots 18 in the base plate 11 and ventilation slots 20 arranged in the housing 19 and discharges air from the housing 19 via ventilation slots 21.

FIGS. 5 to 8 and FIGS. 9 to 13 show in detail two different advantageous embodiments of the base plate 11*a*, 11*b*.

In the first embodiment shown in FIGS. 5 to 8 a base plate 11*a* of bipartite configuration is provided, wherein, for manufacturing the base plate 11*a*, a pipe 22 is molded into the base plate body 23 in a molding process. Thus, an ideal heat transfer through a bonded connection is achieved. On the other hand, there is no risk of leak ages and the like so that this configuration is particularly reliable. The pipe 22 is advantageously made from copper, whereas the base plate body 23 is advantageously molded from aluminum.

Further, an opening 25 and fastening points 26 for accommodating and fastening bearing support and centrifuge motor (both not shown) are illustrated. Moreover, fastening points 27 for fastening the compressor cooling device 14 and connecting points 28, 29 for connecting the pipe 22 to the compressor cooling device 14 are provided. Both on the upper side 30 and on the lower side 31 cooling ribs 32, 33 are provided which are arranged in parallel to each other and define an air flow direction.

In the second advantageous embodiment shown in FIGS. 9 to 13 a base plate 11*b* of multipart configuration is provided, wherein the base plate 11*b* is composed of an upper part 40 and a lower part 41. Both are manufactured by means of a molding process and include molds 42, 43 for a pipe. Instead of molding said parts 40, 41, these parts may also be manufactured by milling and the like. By bolting, gluing or welding or otherwise connecting the two base plate parts 40, 41 an integrally formed base plate 11*b* is produced which also includes a bonded connection. To prevent the risk of leakages and the like, this operation must be carried out in a very accurate manner. Alternatively, a separate pipe may be placed between the plates. In this case, a medium for improving the heat transfer, e.g. a heat transfer paste, is advantageously provided between the parts of the base plate and the placed pipe. In this case, too, a very accurate configuration of the molds and the pipe is required to ensure good heat transfer between the pipe and the plate parts of the base plate.

Figure 13:
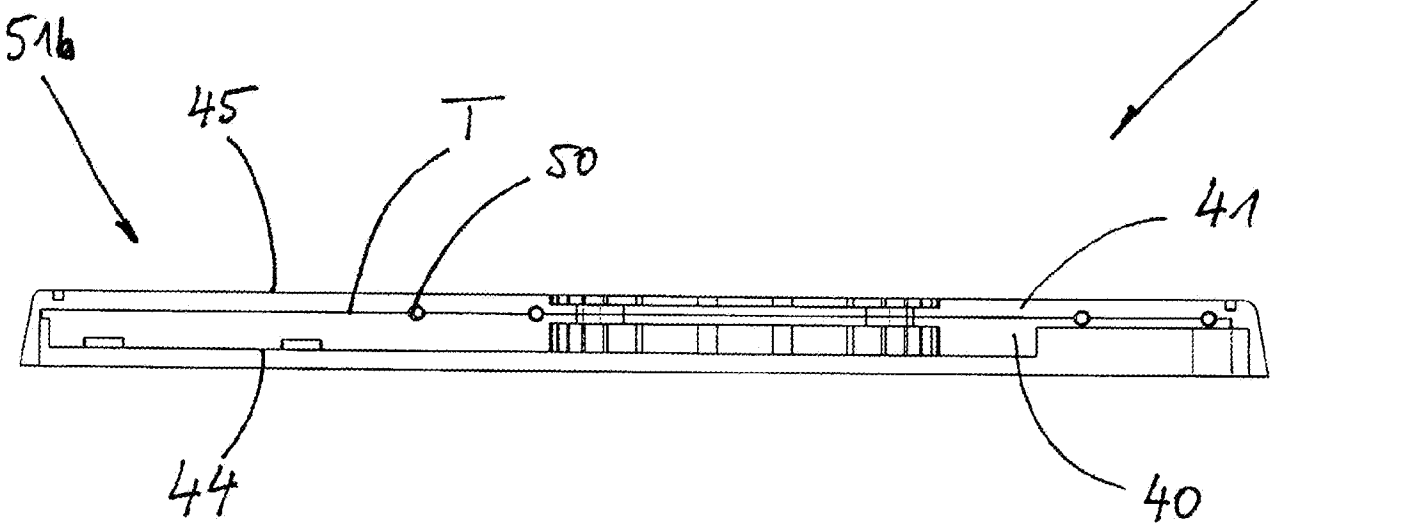
FIG. 13 illustrates a sectional view of the base plate for the centrifuge according to the invention of FIG. 3, in the second advantageous embodiment.

In the base plate 11*b*, too, an opening 25 and fastening points 26 for accommodating and fastening the bearing support and the centrifuge motor (not shown) are provided, and both on the upper side 44 and the lower side 45 of the base plate 11*b* ribs 46, 47 are arranged in parallel to each other. For connection to the compressor cooling device 14 connectors 48, 49 are provided. In particular FIG. 13 illustrates that the upper part 40 is inserted in the lower part 41 and that the pipe 50 is located in the parting plane T.

The ventilation slots 18 arranged in the base plate 11, 11*a*, 11*b* serve not only as openings for air passage but also for separating hotter and colder zones in the base plate 11, 11*a*, 11*b* from each other, wherein the hotter zone is the inner zone, while the colder zone extends along the edge of the base plate 11, 11*a*, 11*b*. Connecting point 29 thus supplies the hotter zone, and connecting point 28 serves for extraction from the colder zone.

In the operating condition of the centrifuge 10 the base plate 11, 11*a*, 11*b* serves as a heat exchanger surface on both sides and thus acts as a condenser 51, 51*a*, 51*b* for the cooling agent passing through the cooling agent guiding means 22, 50 of the compressor cooling device 14. The base plate 11, 11*a*, 11*b* receives the heat of the cooling agent and dissipates it via its surface 30, 31, 44, 45 increased by the ribs 32, 33, 46, 47. In connection with the fan 17 these ribs 32, 33, 46, 47 generate an air flow which dissipates the heat to the outside and thus cools the entire centrifuge 10. The base plate 11, 11*a*, 11*b* is arranged in the centrifuge 10 such that no direct heat contact with the housing 19 exists. Further, the openings 18, 20, 21 are covered with a gauze (not shown) or the like such that fire protection requirements are met.

Although the base plate 11, 11*a*, 11*b* according to the invention includes ribs 32, 33, 46, 47 which are aligned in parallel to each other, angular arrangements, i. e. arrangements deviating from 180°, with respect to each other are in principle also possible. For example, two or more groups of ribs may be provided, wherein the ribs in one group extend in parallel to each other, but between the groups an angle is defined. Further, all ribs may form an angle with respect to each other. Thus, particularly advantageous air flows can be adjusted.

From the above description it becomes evident that the centrifuge 10 according to the invention offers improved cooling in that its required installation space is reduced such that the centrifuge 10 can be of a more compact design with the centrifugation capacity remaining unchanged, or the centrifugation capacity can be increased with the installation dimension remaining unchanged. Further, the number of component parts can be reduced and thus cost and assembly time can be saved.

What is claimed is:

1. A centrifuge, comprising:

a driven centrifuge rotor;

a compressor cooling device;

a cooling medium;

an elongated conveying device;

a housing; and a base plate made in its entirety from metal and forming a base of the housing, wherein the conveying device is either formed by the base plate or enclosed on its entire enveloping surface by the base plate and in direct heat conducting contact on its entire enveloping surface with the base plate, wherein the conveying device receives heat from the compressor cooling device through the cooling medium and transfers the heat to the base plate so that the base plate forms a heat exchanger for the compressor cooling device and operates at least as a portion of a condenser for the cooling medium of the compressor cooling device.

2. The centrifuge according to claim 1, wherein the centrifuge is a laboratory centrifuge.

3. The centrifuge according to claim 1, wherein the conveying device is configured as a pipe.

4. The centrifuge according to claim 3, wherein the conveying device is molded into the base plate or the base plate has at least two components, and wherein the conveying device is arranged in a parting plane between the at least two components of the base plate.

5. The centrifuge according to claim 4, wherein the conveying device is integrated in at least one component of the base plate.

6. The centrifuge according to claim 1, wherein the base plate includes at least one surface-increasing element at least at one of two large main surfaces.

7. The centrifuge according to claim 6, wherein the base plate includes at least one cooling rib.

8. The centrifuge according to claim 1, wherein the base plate includes at least one through hole which is not in air flow communication with the conveying device.

9. The centrifuge according to claim 1, wherein at least one ventilation device is operatively connected with the base plate, and wherein the ventilation device generates an air flow in a housing of the centrifuge, which airflow enters the housing from a side or a bottom.

10. The centrifuge according to claim 9, wherein an air-permeable cover is provided for ventilation openings in the housing.

11. The centrifuge according to claim 1, wherein the base plate is arranged at the housing of the centrifuge so that a heat transfer between the base plate and the housing is interrupted or reduced.

12. A method for cooling a centrifuge, comprising the steps:

using a base plate made in its entirety from metal and forming a base of a housing of a centrifuge at least as a portion of a condenser of a compressor cooling device;

receiving heat from the compressor cooling device through a cooling medium in an elongated conveying device enclosed in its entirety by the base plate and in direct heat conducting contact with the base plate; and transferring the heat to the base plate so that the base plate forms a heat exchanger for the compressor cooling device and operates at least as a portion of a condenser for the cooling medium of the compressor cooling device.

13. The method according to claim 12, wherein the centrifuge is a laboratory centrifuge.

14. The method according to claim 12, wherein at least one ventilation device is provided which generates an air flow parallel to or rising through the base plate.

15. The centrifuge according to claim 1, wherein at least one ventilation device is operatively connected with the base plate, and wherein the ventilation device generates an air flow in a housing of the centrifuge, which airflow enters the housing from a side and a bottom.

16. The centrifuge according to claim 1, wherein the base plate is made from aluminum.

17. The centrifuge according to claim 12, wherein the base plate is made from aluminum.

* * * * *